US005899450A

United States Patent [19]

Gettelfinger et al.

[11] Patent Number: 5,899,450

[45] Date of Patent: May 4, 1999

[54] SHEET SEPARATOR DAM WITH INSET FRICTION ELEMENT

[75] Inventors: Darin Michael Gettelfinger; Edward Alan Rush, both of Lexington; Kevin Dean Schoedinger, Nicholasville; Scott Stephen Williams, Lexington, all of Ky.

[73] Assignee: Lexmark International, Inc., Lexington, Ky.

[21] Appl. No.: 08/919,551

[22] Filed: Aug. 28, 1997

Related U.S. Application Data

[63] Continuation of application No. 08/780,259, Jan. 2, 1997, abandoned, which is a continuation of application No. 08/641,871, May 2, 1996, abandoned.

[51] Int. Cl.[6] ..... B65H 3/52

[52] U.S. Cl. ..... 271/121; 271/161; 271/167

[58] Field of Search ..... 271/121, 124, 271/161, 167

[56] References Cited

U.S. PATENT DOCUMENTS

| | | | |
|---|---|---|---|
| 748,279 | 12/1903 | Hallberg . | |
| 3,126,122 | 3/1964 | Sacre | 221/41 |
| 3,306,491 | 2/1967 | Eisner et al. | 271/41 |
| 3,421,754 | 1/1969 | Schaller et al. | 271/61 |
| 3,873,084 | 3/1975 | Ito | 271/169 |
| 3,944,214 | 3/1976 | Fallos et al. | 271/10 |
| 4,934,684 | 6/1990 | Gysling | 271/34 |
| 5,052,677 | 10/1991 | Shibata | 271/121 X |
| 5,090,679 | 2/1992 | Maekawa et al. | 271/125 |
| 5,163,669 | 11/1992 | Hurd et al. | 271/125 |
| 5,277,417 | 1/1994 | Moritake et al. | 271/121 |
| 5,409,205 | 4/1995 | Macke et al. | 271/133 |

FOREIGN PATENT DOCUMENTS

| | | | |
|---|---|---|---|
| 222944 | 9/1987 | Japan | 271/121 |
| 178139 | 7/1990 | Japan | 271/121 |
| 267228 | 11/1991 | Japan | 271/121 |
| 178484 | 7/1993 | Japan | 271/121 |
| 201570 | 8/1993 | Japan | 271/121 |
| 144620 | 5/1994 | Japan | 271/121 |
| 179540 | 6/1994 | Japan | 271/161 |

*Primary Examiner*—Boris Milef
*Attorney, Agent, or Firm*—John A. Brady

[57] ABSTRACT

A dam has a plurality of substantially parallel ribs with recesses therebetween. At least one of the recesses has a pad therein with its sheet engaging surface being interior of the sheet engaging surfaces of the ribs. The rib surfaces, which are engaged first by the sheets being fed, have a lower coefficient of friction with the sheets than the sheet engaging surface of the pad. If more than one sheet is fed from a stack to the dam, the sheets will strike the rib surfaces first and then the pad surface if not separated from each other by the rib surfaces. Since the pad surface has a coefficient of friction substantially equal to the sheet to sheet friction, this step function in friction helps to separate the top sheet from the next adjacent sheet.

8 Claims, 5 Drawing Sheets

SHEET SEPARATOR DAM WITH INSET FRICTION ELEMENT

This application is a continuation of application Ser. No. 08/780,259, filed Jan. 2, 1997, now abandoned; which is a continuation of application Ser. No. 08/641,871, filed May 2, 1996, now abandoned.

FIELD OF THE INVENTION

This invention relates to a sheet separator for separating adjacent sheets of media being fed from a stack of sheets so that only one sheet is fed to a process station and, more particularly, to a dam separator separating the uppermost or top sheet of a stack of sheets from the next adjacent sheet during feeding of the top sheet from the stack of sheets of media.

BACKGROUND OF THE INVENTION

One problem in feeding a top or bottom sheet of media from a stack of sheets of media is that at least the next adjacent sheet may be fed at the same time. Accordingly, various separating means have previously been suggested for separating a top sheet of a stack of sheets of media from the next adjacent sheet when the feed is from the top of the stack of sheets of media and for separating a bottom sheet of a stack of sheets of media from the next adjacent sheet when the feed is from the bottom of the stack of sheets of media.

It is known to separate a top sheet of a stack of sheets from the next adjacent sheet through using a dam, which is an element having an inclined surface in the path of the top sheet as it is fed from the stack of sheets so that its leading edge will strike the inclined surface of the element. In a printer, for example, the advancement of more than one sheet from the stack of sheets can cause jamming. Therefore, it is necessary to avoid simultaneous advancement of more than one sheet from a stack of sheets of media to a processing station such as a printer, for example.

U.S. Pat. No. 4,934,684 to Gysling discloses a complex and expensive mechanism for advancing only a top sheet from a stack of sheets. A thickness sensor assembly senses the thickness of the sheet or sheets after advancement of the sheet or sheets from the stack past an angled dam, which has a smooth inclined or angled surface and is supposed to separate the top sheet from the next adjacent sheet. If more than one sheet is sensed by the thickness sensor assembly, a signal is produced to cause a brake shoe to frictionally engage the lower surface of a group of two or more sheets to separate the sheets. This allows only the top sheet to be advanced.

When a dam has its inclined surface formed with longitudinally extending ribs, there is corrugation of a sheet of media between the substantially parallel ribs when the sheet is advanced longitudinally along the exterior surface of each of the ribs. This corrugation is due to a buckling force created by resistance to movement of the sheet by the exterior surface of each of the ribs. While this dam is usually successful in separating an uppermost or top sheet from the next adjacent sheet in a stack of sheets, it is not always successful. Thus, multiple feeding of sheets can occur as the sheets advance up the inclined, ribbed surface of the dam.

Additionally, a surface having a coefficient of friction capable of reliably separating heavy media such as envelopes and labels, for example, tends to have more multiple sheet feeding of a light or high friction media such as bond or xerographic paper, for example. This presents the problem of whether to have an inclined surface of a dam capable of reliably separating heavy media or light media. This is not desirable with a printer since a printer needs to be capable of printing both heavy and light media to have a sufficient market.

SUMMARY OF THE INVENTION

The sheet separator of the present invention overcomes the foregoing problems through successfully separating both heavy media and light or high friction media with a dam having an inclined, ribbed surface. The sheet separator of the present invention accomplishes this through having the exterior surface of each of its ribs of a lower coefficient of friction relative to the sheets than the coefficient of friction between the sheets and having at least one of the areas between the substantially parallel ribs with a surface having a higher coefficient of friction relative to the sheets than the exterior surface of the ribs and substantially equal to the coefficient of friction between the sheets.

Any higher friction area is disposed so that it is not struck by the sheets being advanced until after the leading edges of the sheets have struck the lower friction, exterior surface of each of the ribs. Thus, each of the sheets is corrugated during movement along the lower friction, exterior surface of the ribs.

This corrugation causes at least the lowermost of the sheets to extend beneath a plane containing each of the lower friction, exterior surfaces of the ribs so that the higher friction area or areas will be engaged by at least the lowermost of the sheets to increase the friction between the lowermost sheet and the higher friction area or areas. This increased friction on the surface of the lowermost sheet remote from the top or uppermost sheet is substantially equal to the friction between the sheets so that only the top or uppermost sheet will be advanced along the inclined ribbed surface of the dam.

An object of this invention is to provide a sheet separator having two surfaces of different coefficients of friction available for separating each sheet from the next adjacent sheet in a stack of sheets.

Another object of this invention is to provide a sheet separator capable of separating sheets fed from a stack of sheets irrespective of whether the thickness of the sheets in two stacks are different even though the sheets in a specific stack have substantially the same thickness.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
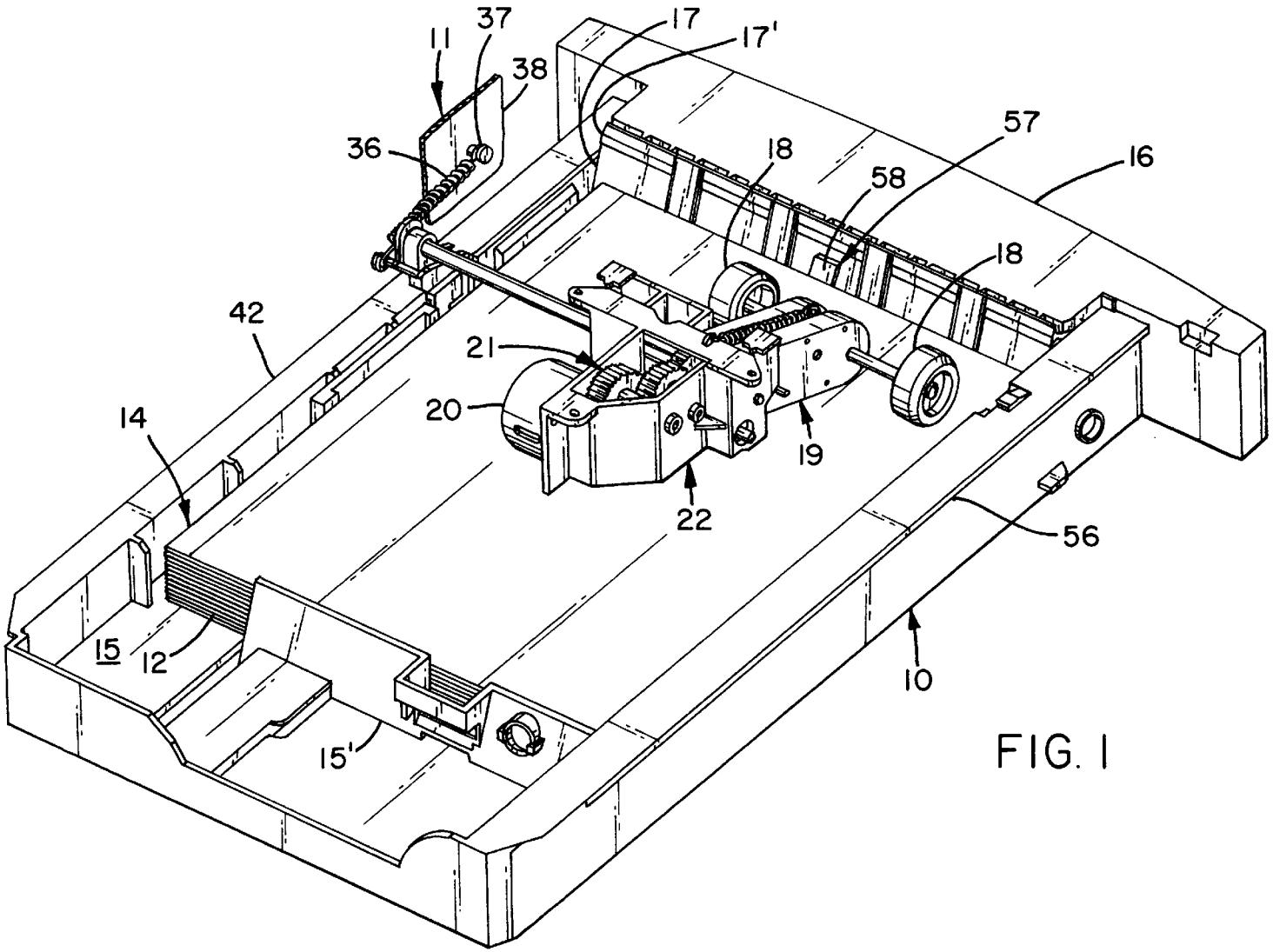
FIG. 1 is a perspective view of a printer tray having the sheet separator of the present invention with a stack of sheets of media therein and shown enlarged for clarity purposes.
Figure 2:
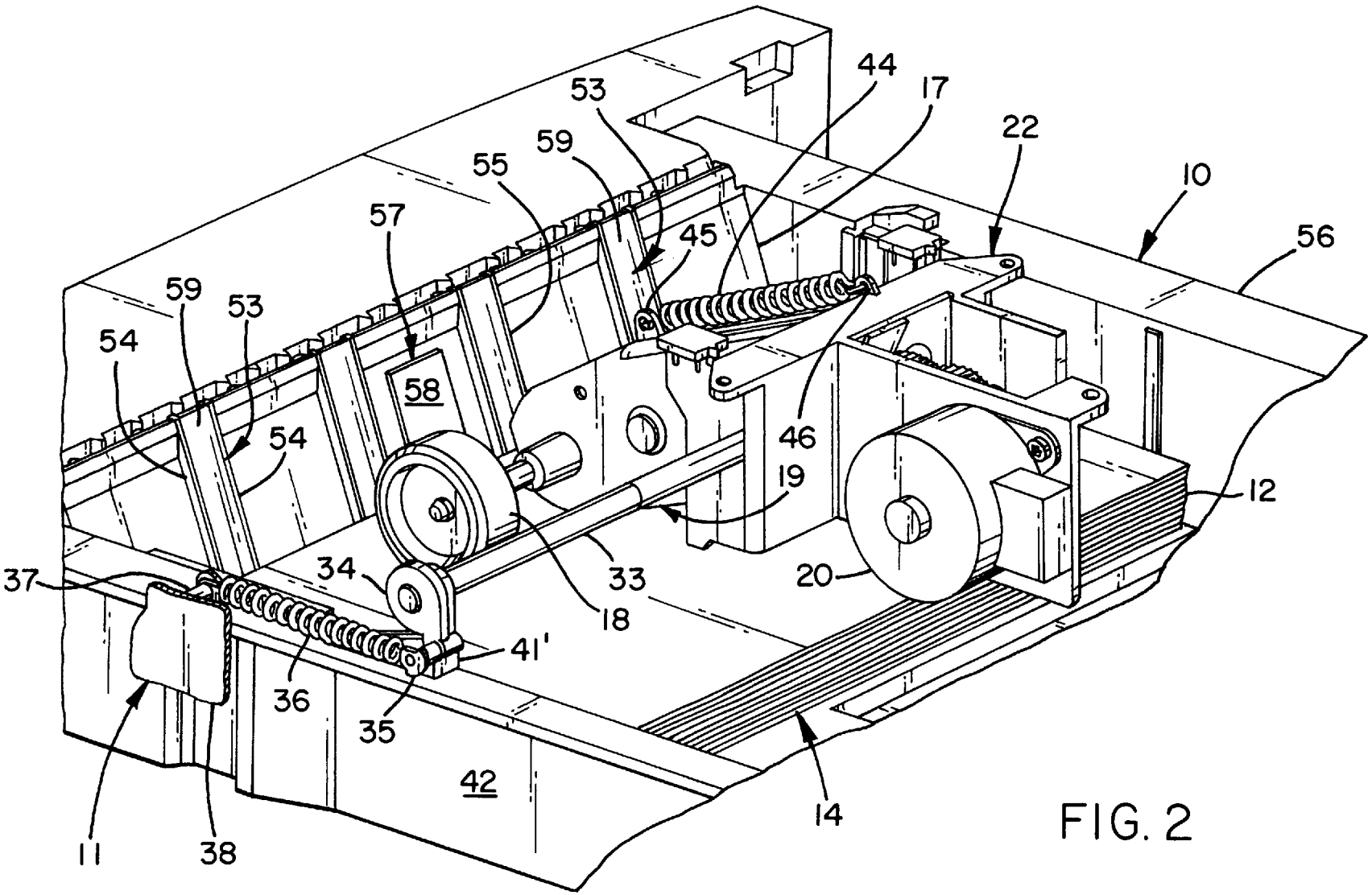
FIG. 2 is enlarged perspective view of a portion of the tray of FIG. 1 and taken from the opposite side of FIG. 1.

Referring to the drawings and particularly FIG. 1, there is shown a tray 10 used in a printer 11. The tray 10 supports a plurality of sheets 12 of a media such as bond paper, for example, in a stack 14. The sheets 12 may be other media such as labels or envelopes, for example.

The tray 10 has a bottom surface or wall 15 supporting the stack 14 of the sheets 12 therein. The tray 10 has a rear restraint 15' abutting a trailing edge of each of the sheets 12 of the stack 14. Adjacent its front end 16, the tray 10 has an inclined surface or wall 17 integral with the bottom surface 15 of the tray 10.

The surface 17 is inclined at an obtuse angle to the bottom surface 15 of the tray 10 and to the adjacent end of the stack 14 of the sheets 12. The inclined or angled surface 17 constitutes a portion of a dam against which each of the sheets 12 in the stack 14 is advanced into engagement. The dam also includes a vertical surface 17' above the inclined surface 17. The sheet 12 is advanced from the vertical surface 17' towards a processing station of the printer 11 at which printing occurs.

Each of the sheets 12 is advanced from the stack 14 of the sheets 12 by a pair of feed rollers 18, which are rotatably mounted on a pivotally mounted arm 19. The feed rollers 18 are driven from a motor 20 through a gear drive train 21. The motor 20 is alternately turned off and on by control means (not shown) as each of the sheets 12 is advanced from the top of the stack 14 of the sheets 12.

Figure 3:
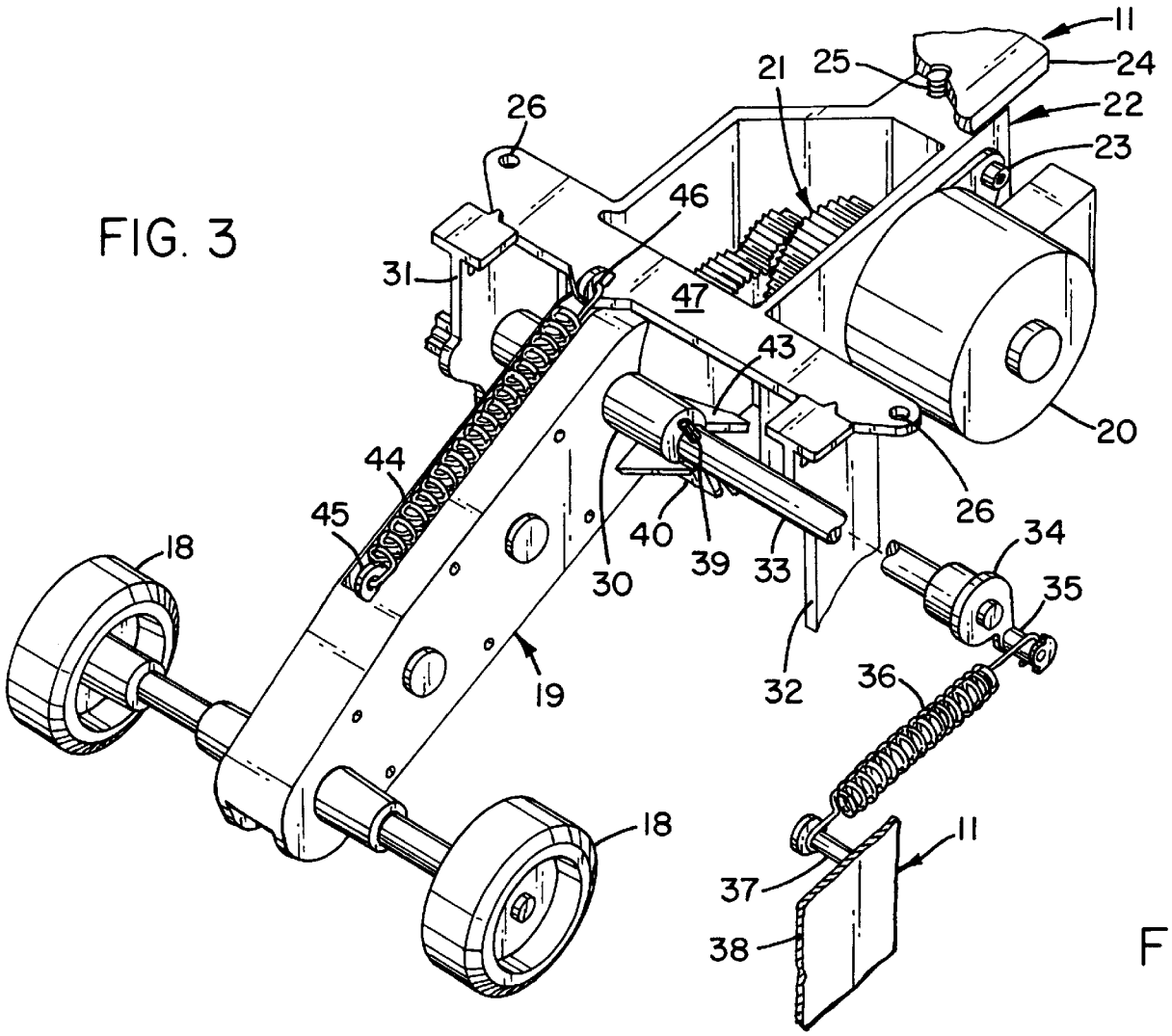
FIG. 3 is a perspective view, partly exploded, of a sheet advancing mechanism for advancing the uppermost sheet of a stack of sheets from the tray of FIG. 1 to a processing station of the printer at which printing occurs.

The motor 20 (see FIG. 3) is supported on a bracket 22 by screws 23 (one shown). The bracket 22 is fixed to a sheet metal portion 24 of the printer 11. Self-tapping screws 25 extend upwardly through clearance holes 26 in the bracket 22 into extruded holes (not shown) in the sheet metal portion 24 of the printer 11.

The pivotally mounted arm 19 has a sleeve 30 fixed thereto. The sleeve 30 is rotatably supported by a pair of substantially parallel vertical walls 31 and 32 of the bracket 22 through a pivot shaft 33 extending through the walls 31 and 32 and being rotatably supported thereby.

Figure 5:
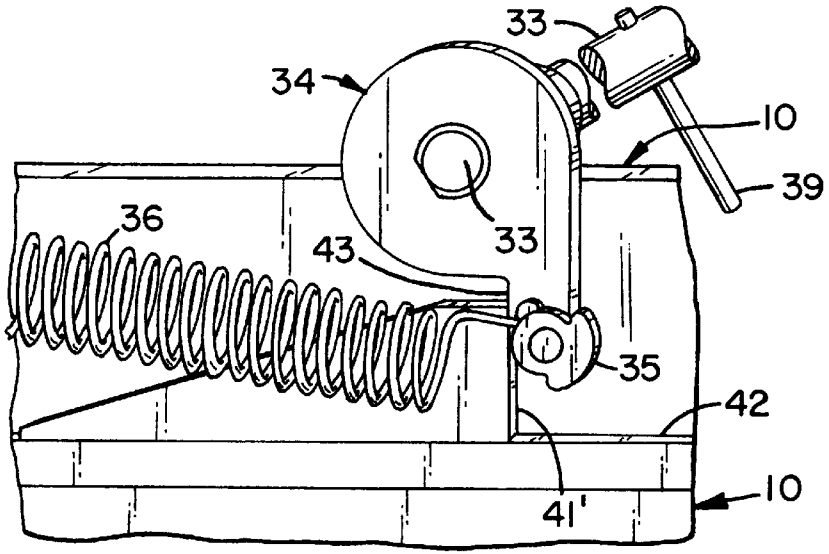
FIG. 5 is an enlarged fragmentary side elevational view of a portion of the tray of FIG. 1 and showing the pin of FIG. 4 for moving feed rollers of the sheet advancing mechanism of FIG. 3 into engagement with the uppermost or top sheet in a stack of sheets within the tray when the tray is inserted within a printer.

A bellcrank 34 (see FIG. 5) is mounted on one end of the pivot shaft 33 and fixed thereto. The bellcrank 34 has a spring connector 35 fixed thereto and to which one end of a spring 36 is secured. The spring 36 has its other end connected to a post 37 (see FIG. 1) extending from a side frame 38 of the printer 11.

Figure 4:
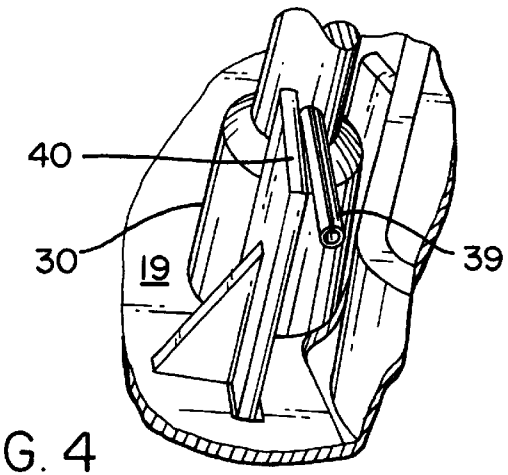
FIG. 4 is an enlarged fragmentary perspective view of a portion of the sheet advancing mechanism of FIG. 3 and looking up from beneath to show a pin for moving feed rollers of the sheet advancing mechanism of FIG. 3 into engagement with the uppermost or top sheet in a stack of sheets within the tray when the tray is inserted within a printer.

The spring 36 (see FIG. 5) continuously urges the bellcrank 34 clockwise so that a pin 39 fixed to the pivot shaft 33 engages a rib 40 (see FIGS. 3 and 4) on the sleeve 30. This engagement of the pin 39 with the rib 40 holds the pivotally mounted arm 19 in a raised position in which the feed rollers 18 can not engage a top sheet 41 (see FIG. 8) of the stack 14 (see FIG. 1). This occurs when the tray 10 is removed from the printer 11.

When the tray 10 is inserted within the printer 11, a vertical wall 41' (see FIG. 5) extending upwardly from a side wall 42 of the tray 10 engages a flat surface 43 of the bellcrank 34 to rotate the bellcrank 34 counterclockwise against the force of the spring 36. This counterclockwise rotation of the bellcrank 34 causes counterclockwise rotation of the pivot shaft 33, which has the bellcrank 34 fixed thereto, so that the pin 39 on the pivot shaft 33 ceases to engage the rib 40 (see FIG. 3) on the sleeve 30. Without the pin 39 engaging the rib 40, the pivotally mounted arm 19 pivots counterclockwise (as viewed in FIG. 3) because of gravity so that the feed rollers 18 engage the top of the stack 14 (see FIG. 1) of the sheets 12.

A counterbalance spring 44 (see FIG. 3) extends between an ear 45 on the pivotally mounted arm 19 and an ear 46 in a flat portion 47 of the bracket 22. The counterbalance spring 44 limits the force applied by the feed rollers 18 to the top of the sheets 12 (see FIG. 1) in the stack 14.

When the feed rollers 18 are in the feed or sheet advance position in which they engage the top sheet 41 (see FIG. 8) of the stack 14 (see FIG. 1) of the sheets 12, the top sheet 41 (see FIG. 8) of the stack 14 (see FIG. 1) is advanced by rotation of the feed rollers 18 through energization of the motor 20. This causes leading edge 49 (see FIG. 7) of the top sheet 41 to engage the inclined surface 17 (see FIG. 1) of the tray 10, which is preferably formed of plastic.

The inclined surface 17 includes a plurality of substantially parallel portions 50 (see FIG. 8) protruding from a base surface 51. Each of the protruding portions 50 of the inclined surface 17 has a recess 52 therein to receive a rib 53 protruding slightly beyond extensions 54 of each of the protruding portions 50 of the inclined surface 17. The extensions 54 are positioned on each side of each of the plurality of substantially parallel ribs 53 to form the side walls of each of the recesses 52 in the tray 10 in which the ribs 53 are retained. The ribs 53 may be formed of any suitable low friction material but are preferably formed of stainless steel.

A recess 55 is formed in the inclined surface 17 between each adjacent pair of the protruding portions 50. The recesses 55 also are formed in the inclined surface 17 between one of the outermost of the protruding portions 50 and the side wall 42 (see FIG. 1) of the tray 10 and between the other of the outermost of the protruding portions 50 (see FIG. 8) and a side wall 56 (see FIG. 1) of the tray 10.

Figure 8:
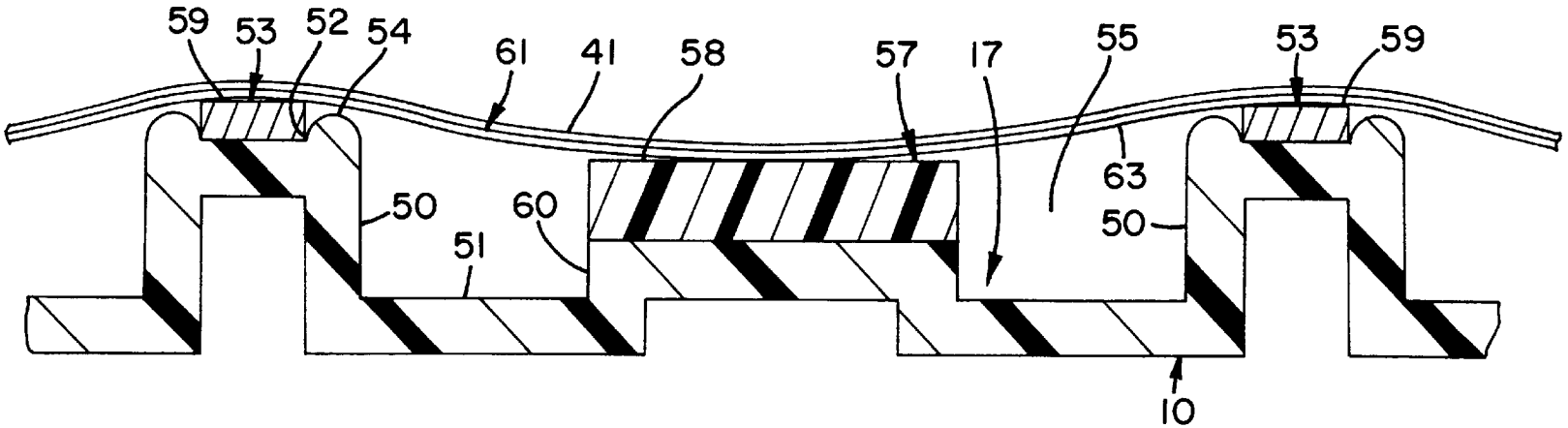
FIG. 8 is an enlarged fragmentary schematic sectional view of a portion of the dam of FIG. 6 showing two adjacent contacting sheets striking the rib surfaces of the dam and the pad surface to corrugate the two sheets to separate them with the sheets shown enlarged for clarity purposes.

As shown in FIG. 8, one of the recesses 55 between two of the substantially parallel protruding portions 50 has a pad 57 disposed therein. The pad 57 has its surface 58 slightly inward of a plane containing a sheet engaging, exterior surface 59 of each of the ribs 53.

The surface 58 of the pad 57 is preferably 0.030" inwardly from the plane containing each of the surfaces 59 of the ribs 53. The base surface 51 of the inclined surface 17 includes a raised, support portion 60 adhered to the pad 57 to dispose the surface 58 of the pad 57 at the desired distance relative to the plane containing the surfaces 59 of the ribs 53.

When the top sheet 41 of the stack 14 (see FIG. 1) of the sheets 12 is advanced therefrom, the leading edge 49 (see FIG. 7) of the top sheet 41 initially engages the surfaces 59 of the ribs 53 so that the top sheet 41 will begin to bend as it is advanced along the surfaces 59 of the ribs 53. This bending of the top sheet 41 causes it to corrugate, as indicated in FIG. 8, as it moves over the surfaces 59 of the ribs 53.

If a next adjacent sheet 61 in the stack 14 (see FIG. 1) also has been advanced from the stack 14 with the top sheet 41 (see FIG. 7), its leading edge 62 also will have engaged the inclined surfaces 59 of the ribs 53 and also will corrugate. Corrugation of the next adjacent sheet 61 causes its lower surface 63 (see FIG. 8), which is remote from the top sheet 41, to engage the surface 58 of the pad 57.

With the surface 58 of the pad 57 having a higher coefficient of friction with the sheets 41 and 61 than the surfaces 59 of the ribs 53 and substantially equal to the coefficient of friction between the two sheets 41 and 61 being advanced along the surfaces 59 of the ribs 53, the sheets 41 and 61 cannot continue to adhere to each other as the feed rollers 18 (see FIG. 7) advance the sheets 41 and 61 upwardly along the inclined surfaces 59 of the ribs 53. Accordingly, only the top sheet 41 continues to be advanced along the inclined surfaces of the ribs 53 after there has been separation of the two adjacent sheets 41 and 61.

Figure 7:
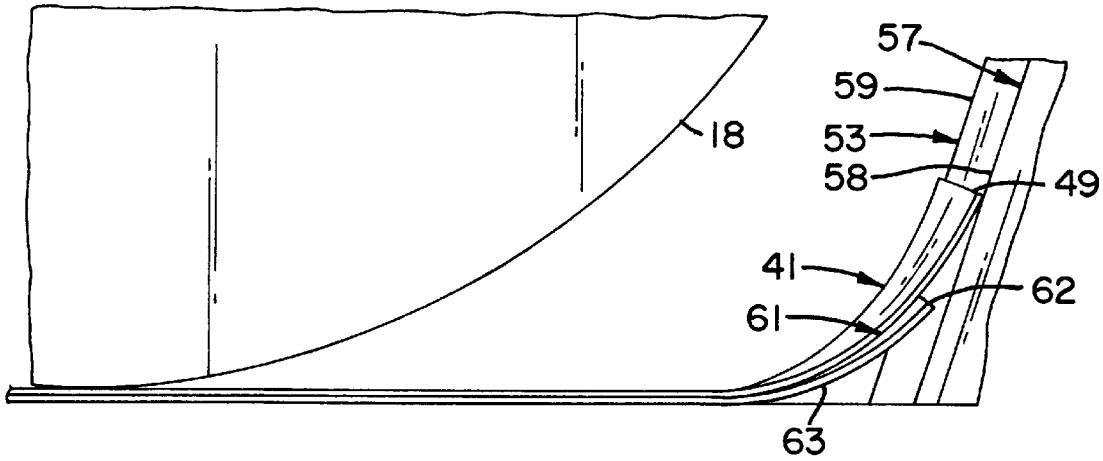
FIG. 7 is a schematic side elevational diagram showing one of the three possible relationships of two adjacent contacting sheets striking a pad surface with the sheets shown enlarged for clarity purposes.

As schematically shown in FIG. 7, the leading edge 49 of the top sheet 41 can engage the surface 58 of the pad 57 before the leading edge 62 of the next adjacent sheet 61. It should be understood that the leading edge 62 of the next adjacent sheet 61 could engage the surface 58 of the pad 57 before the leading edge 49 of the top sheet 41 or both the leading edges 49 and 62 could simultaneously engage the surface 58 of the pad 57. Thus, there are three different possibilities of the leading edges 49 and 62 engaging the surface 58 of the pad 57, but each produces separation of the sheets 41 and 61.

It should be understood that the motor 20 (see FIG. 1) must produce a sufficient torque to overcome the friction forces incurred by one or more of the sheets 12 striking the surface 58 of the pad 57.

Figure 6:
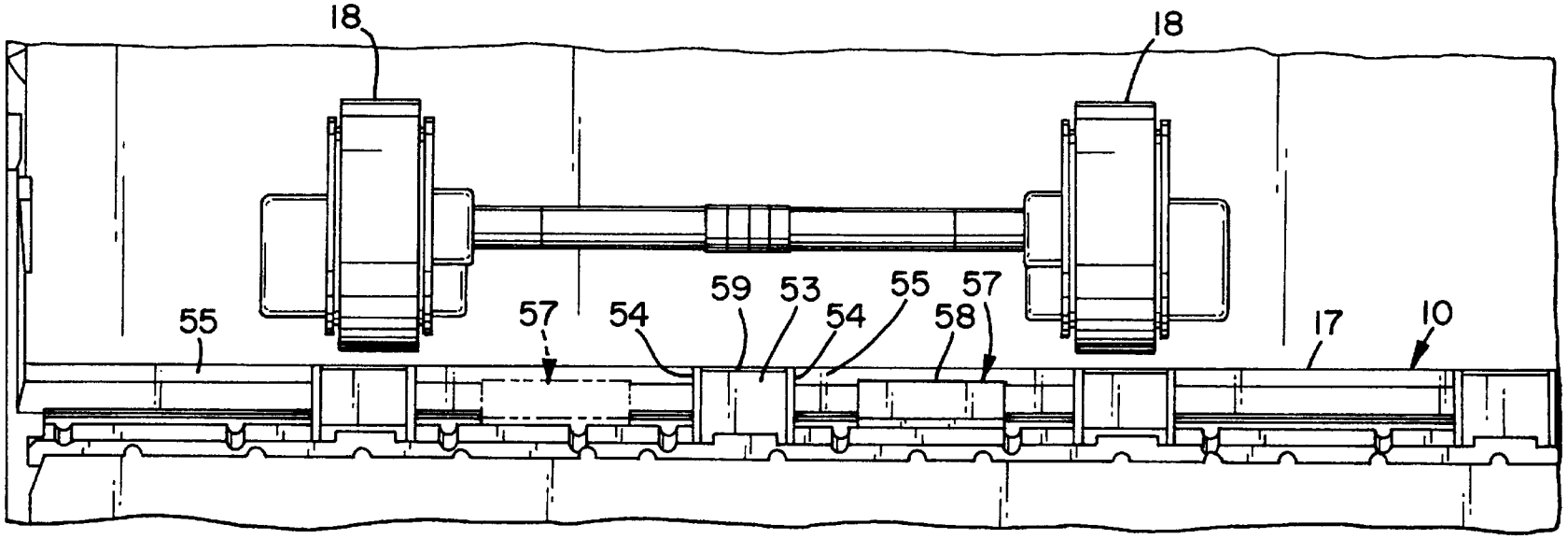
FIG. 6 is a top plan view of a portion of the tray of FIG. 1 without any sheets therein and showing a dam of the invention.

Instead of the inclined surface 17 (see FIG. 6) having only the pad 57 in one of the recesses 55, the inclined surface 17 may have two of the pads 57 with the second of the pads 57 shown in phantom, for example. These are disposed symmetrically with respect to the feed rollers 18.

With either the two pads 57 or the single pad 57, each of the pads 57 has at least the sheet engaging surface 58 formed of a material having a coefficient of friction with the sheets 12 (see FIG. 1) of the stack 14 greater than the coefficient of friction of the sheet engaging surface 59 (see FIG. 8) of each of the ribs 53. It is preferred that the entire pad 57 be formed of the same material.

One suitable example of the material of the pad 57 or of at least the surface 58 of the pad 57 is a plastic sold by Miles Polymer Division of Bayer as TEXIN 345D. TEXIN 345D has a coefficient of friction of about 0.55 with paper while the stainless steel surface 59 of each of the ribs 53 has a coefficient of friction of about 0.2 with paper.

The specific coefficient of friction of the pad 57 or of at least the material of the sheet engaging surface 58 of the pad 57 relative to the sheets 12 (see FIG. 1) of the stack 14 is preferably in the range of 0.45 to 0.65. This range is believed to be sufficient to enable labels and perforated cards, for example, to be utilized in the same printer with bond paper, for example, without more than one of the sheets being advanced in the same feed through the printer.

While the sheet separator of the present invention has been shown and described as being used with a printer, it should be understood that the sheet separator of the present invention may be used with any apparatus feeding a sheet from a stack to a processing station, for example, in which only one sheet at a time is to be fed from the stack to the processing station.

An advantage of this invention is that a sheet feeding mechanism can feed sheets of media in which the sheets in one stack of sheets are of substantially the same thickness but a different thickness than the sheets in another stack. Another advantage of this invention is that it reduces the tendency for multi-sheet feeding when a stack of sheets is composed of sheets of a thickness different than the thickness of the sheets in another stack when a dam is the sheet separator.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A sheet separator containing a stack of individual sheets for separating adjacent sheets of media being fed from said stack of sheets comprising:

a rotatable sheet feed roller, a surface for supporting a bottom of said stack of sheets, and having a sheet dispensing end, an inclined element located adjacent said end of said surface, said inclined element being inclined at an obtuse angle to said stack of sheets, said stack having a top opposite said bottom, said sheet feed roller contacting said top of said stack and being spaced away from said inclined element and being rotatable to move said sheets from said top of said stack into said inclined element, said inclined element having two protruding ribs which engage the end of sheets moved by said rotation of said feed roller, said inclined element having between said two ribs a high-friction surface fixedly located under the plane of the outer surfaces of said two ribs, and a stack of individual sheets supported by said surface for supporting, said individual sheets being flexible to permit the lower sheet to corrugate and contact said high-friction surface when two sheets are moved together from said stack by said feed roller, wherein no nip is formed between said sheet feed roller and said inclined element.

2. The sheet separator according to claim 1 in which said outer surface each of said two ribs is stainless steel.

3. The sheet separator according to claim 1 also comprising a plurality of protruding ribs on said inclined element in addition to said two ribs, said plurality of ribs being located spaced from said two ribs and said high-friction surface, the outer surface of said plurality of ribs being in substantially the same plane as said plane of the outer surface of said two ribs and in which said high-friction surface contacted by said corrugated sheets is only between said two ribs.

4. The sheet separator according to claim 3 in which said outer surfaces of each of said two ribs and said plurality of ribs is stainless steel.

5. The sheet separator according to claim 4 in which said two ribs are located with one of said plurality of ribs on one side of said two ribs and another one of said plurality of ribs on the side of said two ribs opposite said one side.

6. The sheet separator according to claim 3 in which said two ribs are located with one of said plurality of ribs on one side of said two ribs and another one of said plurality of ribs on the side of said two ribs opposite said one side.

7. The sheet separator according to claim 1 also comprising a third protruding rib on said inclined element spaced from one of said two ribs, the outer surface of said third rib being in substantially the same plane as said plane of said outer surfaces of said two ribs, said inclined element having between said third rib and said one of said two ribs a second high-friction surface fixedly located under the plane of said outer surfaces of said two ribs, said individual sheets being flexible to permit the lower sheet to corrugate and contact said second high-friction surface when two sheets are moved together from said stack by said feed roller.

8. The sheet separator according to claim 7 in which said outer surfaces of each of said two ribs and said third rib is stainless steel.

* * * * *